US008010028B2

(12) United States Patent
Shinshi

(10) Patent No.: US 8,010,028 B2
(45) Date of Patent: Aug. 30, 2011

(54) IMAGE FORMING APPARATUS AND FIXING DEVICE

(75) Inventor: Akira Shinshi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 748 days.

(21) Appl. No.: 11/812,387

(22) Filed: Jun. 19, 2007

(65) Prior Publication Data

US 2007/0292175 A1 Dec. 20, 2007

(30) Foreign Application Priority Data

Jun. 19, 2006 (JP) ..... 2006-168628

(51) Int. Cl.
*G03G 15/20* (2006.01)

(52) U.S. Cl. ..... 399/329; 399/333

(58) Field of Classification Search ..... 399/329, 399/333, 334, 122

See application file for complete search history.

(56) References Cited

U.S. PATENT DOCUMENTS

| | | | | |
|---|---|---|---|---|
| 5,683,509 | A * | 11/1997 | Sollinger et al. | 118/227 |
| 5,839,043 | A * | 11/1998 | Okabayashi et al. | 399/329 |
| 6,476,357 | B2 * | 11/2002 | Ohno et al. | 219/216 |
| 6,597,888 | B1 * | 7/2003 | Abe et al. | 399/329 |
| 6,671,488 | B2 * | 12/2003 | Izawa et al. | 399/329 |
| 6,882,820 | B2 | 4/2005 | Shinshi et al. | |
| 7,127,204 | B2 | 10/2006 | Satoh et al. | |
| 2001/0022909 | A1 * | 9/2001 | Takeuchi et al. | 399/328 |
| 2002/0044807 | A1 * | 4/2002 | Uehara et al. | 399/333 |
| 2005/0163543 | A1 | 7/2005 | Satoh et al. | |
| 2005/0271433 | A1 * | 12/2005 | Ono et al. | 399/329 |
| 2006/0002737 | A1 | 1/2006 | Shinshi | |
| 2006/0029444 | A1 * | 2/2006 | Naito et al. | 399/329 |
| 2006/0054612 | A1 * | 3/2006 | Sanpei et al. | 219/216 |
| 2006/0116230 | A1 | 6/2006 | Satoh et al. | |
| 2006/0165429 | A1 | 7/2006 | Satoh et al. | |
| 2006/0216077 | A1 * | 9/2006 | Komuro | 399/328 |
| 2007/0003334 | A1 | 1/2007 | Shinshi et al. | |

(Continued)

FOREIGN PATENT DOCUMENTS

| | | |
|---|---|---|
| JP | 04-044083 | 2/1992 |

(Continued)

OTHER PUBLICATIONS

Machine translation of Ishibe et al. (JP 2005-215,601, Listed in IDS).*

(Continued)

*Primary Examiner* — David M Gray
*Assistant Examiner* — Rodney Bonnette
(74) *Attorney, Agent, or Firm* — Harness, Dickey & Pierce, P.L.C.

(57) ABSTRACT

An image forming apparatus includes an image forming device for forming a toner image on a recording medium and a fixing device for fixing the toner image formed on the recording medium by applying heat and pressure to the recording medium. In the fixing device, an endless belt, having flexibility, moves to apply heat to the recording medium. A metal thermal conductor, having a pipe shape and provided inside a loop formed by the endless belt, guides the moving endless belt. A heat source heats the metal thermal conductor. A pressing member presses the metal thermal conductor via the endless belt to form a nip between the endless belt and the pressing member. At the nip, the endless belt and the pressing member nip the recording medium bearing the toner image to apply heat and pressure to the recording medium.

40 Claims, 10 Drawing Sheets

U.S. PATENT DOCUMENTS

| | | | |
|---|---|---|---|
| 2007/0014603 | A1 | 1/2007 | Satoh et al. |
| 2007/0059003 | A1 | 3/2007 | Shinshi et al. |
| 2007/0059071 | A1 | 3/2007 | Shinshi et al. |

FOREIGN PATENT DOCUMENTS

| | | |
|---|---|---|
| JP | 04-156576 | 5/1992 |
| JP | 08-248791 | 9/1996 |
| JP | 11-161073 | 6/1999 |
| JP | 2003-270980 | 9/2003 |
| JP | 2004-004568 | 1/2004 |
| JP | 2004-053618 | 2/2004 |
| JP | 2004-286922 | 10/2004 |
| JP | 2005-181474 | 7/2005 |
| JP | 2005-215601 | 8/2005 |
| JP | 2006-039049 | 2/2006 |
| JP | 2006-071998 | 3/2006 |
| JP | 2006-072073 | 3/2006 |
| JP | 2006-098931 | 4/2006 |
| JP | 2007-192846 | 8/2007 |

OTHER PUBLICATIONS

U.S. Appl. No. 10/991,545, filed Nov. 19, 2004.
Office Action dated Mar. 31, 2011 for corresponding Japanese Patent Application No. 2006-168628.

* cited by examiner

IMAGE FORMING APPARATUS AND FIXING DEVICE

PRIORITY STATEMENT

The present patent application claims priority of Japanese Patent Application No. 2006-168628 filed on Jun. 19, 2006 in the Japan Patent Office, the entire contents of which are incorporated by reference herein.

BACKGROUND

1. Technical Field

Some example embodiments generally relate to an image forming apparatus and/or a fixing device, for example, for fixing a toner image on a recording medium.

2. Description of Background Art

A background image forming apparatus, for example, a copying machine, a facsimile machine, a printer, or a multi-function printer having copying, printing, scanning, and facsimile functions, forms a toner image on a recording medium (e.g., a sheet) according to image data by an electrophotographic method. For example, a charger charges a surface of an image carrier (e.g., a photoconductor). An optical writer emits a light beam on the charged surface of the photoconductor to form an electrostatic latent image on the photoconductor according to image data. The electrostatic latent image is developed with a developer (e.g., toner) to form a toner image on the photoconductor. A transfer device transfers the toner image formed on the photoconductor onto a sheet. A fixing device applies heat and pressure to the sheet bearing the toner image to fix the toner image on the sheet. The sheet bearing the fixed toner image is output onto the outside of the image forming apparatus.

The fixing device generally includes a pressing roller and/or a fixing roller. The pressing roller and the fixing roller oppose each other to form a nip between the pressing roller and the fixing roller. While the pressing roller and the fixing roller nip a sheet bearing a toner image, the pressing roller and the fixing roller apply pressure and heat to the sheet bearing the toner image to fix the toner image on the sheet. Alternatively, the fixing device may include a fixing belt instead of the fixing roller.

FIG. 1 illustrates an example background fixing device 41RA using a belt method. In the fixing device 41RA, a fixing belt 103 is looped over a fixing roller 102 and a heating roller 104. The fixing roller 102 opposes a pressing roller 101 via the fixing belt 103. A tension applier 107 includes a spring 108 and/or a roller 109 and applies tension to the fixing belt 103 at a position between the fixing roller 102 and the heating roller 104. The heating roller 104 includes a heater 105 and heats the fixing belt 103. The pressing roller 101 presses the fixing roller 102 via the fixing belt 103 to form a nip between the pressing roller 101 and the fixing belt 103. While the pressing roller 101 and the fixing belt 103 nip a sheet P bearing a toner image, the pressing roller 101 and the fixing belt 103 apply pressure and heat to the sheet P to fix the toner image on the sheet P. A separator 106 separates the sheet P bearing the fixed toner image and fed by the pressing roller 101 and the fixing belt 103 in a direction C from the fixing belt 103. A thermistor 110 detects a temperature of the fixing belt 103.

FIG. 2 illustrates another example background fixing device 41RB using a SURF method (e.g., a film method). In the fixing device 41RB, a ceramic heater 113 opposes a pressing roller 111 via a fixing belt 112 having an endless belt shape. A holder 114 holds the ceramic heater 113. A support 115 supports the holder 114. The pressing roller 111 presses the ceramic heater 113 via the fixing belt 112 to form a nip between the pressing roller 111 and the fixing belt 112. The ceramic heater 113 heats the fixing belt 112 at the nip.

FIG. 3 illustrates yet another example background fixing device 41RC using a roller method. In the fixing device 41RC, a pressing roller 121 presses a fixing roller 122 to form a nip between the pressing roller 121 and the fixing roller 122. A heater 123 is provided inside the fixing roller 122 having a thin thickness.

Image forming apparatuses may need to shorten a warm-up time period needed to increase the temperature of the image forming apparatus up to a reference temperature at which a print operation is properly performed after the image forming apparatus is powered on. Image forming apparatuses may also need to shorten a first print time period needed for the image forming apparatus to finish outputting a sheet bearing a fixed toner image onto the outside of the image forming apparatus after the image forming apparatus receives a print request. Image forming apparatuses may also need to form a toner image on a sheet at a higher speed.

When the fixing device 41RA (depicted in FIG. 1) is provided in a high-speed image forming apparatus, the fixing belt 103 may rotate at a high speed. Therefore, an increased amount of heat may be radiated at a portion of the fixing belt 103 other than the nip, resulting in faulty fixing.

The fixing device 41RB (depicted in FIG. 2) has a decreased heat capacity compared to the fixing device 41RA (depicted in FIG. 1) and thereby is quickly heated with a compact structure. However, the ceramic heater 113 heats the fixing belt 112 at the nip only. Heat is easily drawn from the fixing belt 112 to a sheet bearing a toner image and having a decreased temperature at an entrance to the nip, resulting in faulty fixing. In the fixing device 41RB, the holder 114 and the support 115 are provided inside a loop formed by the fixing belt 112. The holder 114 and the support 115 having an increased heat capacity absorb heat generated by the ceramic heater 113, resulting in a decreased thermal conversion efficiency. When the rotating fixing belt 112 moves away from the ceramic heater 113, forced convection cools the fixing belt 112, resulting in a decreased thermal conversion efficiency.

In the fixing device 41RA or 41RB, the rotating fixing belt 103 or 112 may move in a thrust direction to collide with a stopper, and may be damaged. When a user removes a jammed sheet from the fixing device 41RA or 41RB, a force is applied to the fixing belt 103 or 112. When the applied force bends the fixing belt 103 or 112, a small or large kink is formed on the fixing belt 103 or 112. The small kink may break the fixing belt 103 or 112. The large kink may appear as a faulty toner image on a sheet when a fixing operation is performed.

The fixing device 41RC (depicted in FIG. 3) having a simple structure has a decreased heat capacity. However, a center of curvature of the nip faces a toner image on a sheet nipped by the pressing roller 121 and the fixing roller 122. Therefore, the sheet is adhered around the fixing roller 122 via the toner image. The fixing device 41RC may include a separator (e.g., a nail, a plate, and/or the like) for preventing the sheet from adhering around the fixing roller 122. However, the separator needs to apply an increased force to the sheet and the fixing roller 122 to separate the sheet from the fixing roller 122. The separator may scrape the toner image on the sheet, resulting in a faulty toner image on the sheet.

SUMMARY

At least one embodiment may provide an image forming apparatus that includes an image forming device and a fixing device. The image forming device forms a toner image on a recording medium. The fixing device fixes the toner image formed on the recording medium by applying heat and pressure to the recording medium. The fixing device includes an endless belt, a metal thermal conductor, a heat source, and a pressing member. The endless belt, having flexibility, moves to apply heat to the recording medium. The metal thermal conductor has a pipe shape and is provided inside a loop formed by the endless belt. The metal thermal conductor guides the moving endless belt. The heat source heats the metal thermal conductor. The pressing member presses the metal thermal conductor via the endless belt to form a nip between the endless belt and the pressing member. At the nip, the endless belt and the pressing member nip the recording medium bearing the toner image to apply heat and pressure to the recording medium.

At least one embodiment may provide a fixing device for fixing a toner image on a recording medium by applying heat and pressure to the recording medium. The fixing device includes an endless belt, a metal thermal conductor, a heat source, and a pressing member. The endless belt, having flexibility, moves to apply heat to the recording medium. The metal thermal conductor has a pipe shape and is provided inside a loop formed by the endless belt. The metal thermal conductor guides the moving endless belt. The heat source heats the metal thermal conductor. The pressing member presses the metal thermal conductor via the endless belt to form a nip between the endless belt and the pressing member. At the nip, the endless belt and the pressing member nip the recording medium bearing the toner image to apply heat and pressure to the recording medium.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
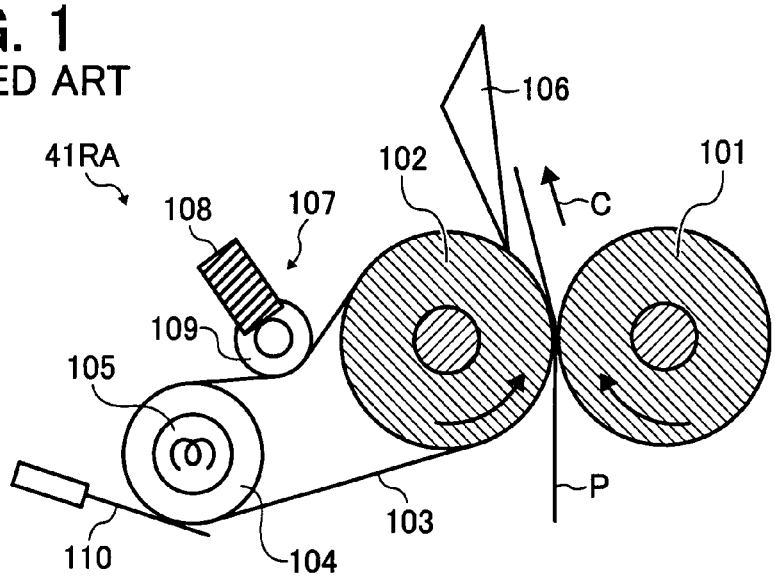
FIG. 1 RELATED ART
FIG. 1 is a sectional view of a related art fixing device.
Figure 2:
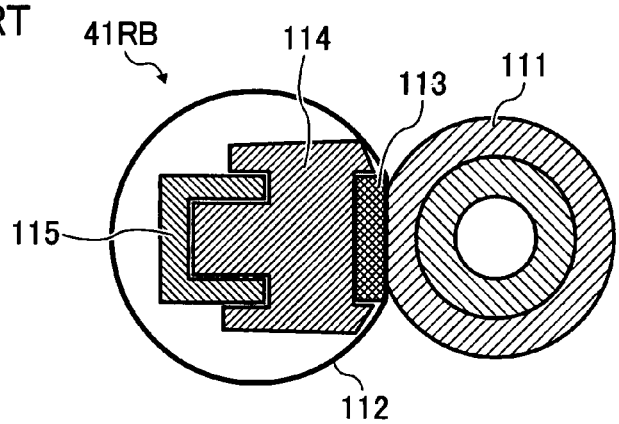
FIG. 2 RELATED ART
FIG. 2 is a sectional view of another related art fixing device.
Figure 3:
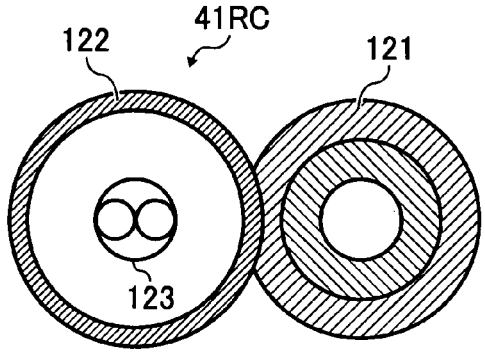
FIG. 3 RELATED ART
FIG. 3 is a sectional view of yet another related art fixing device.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 4:
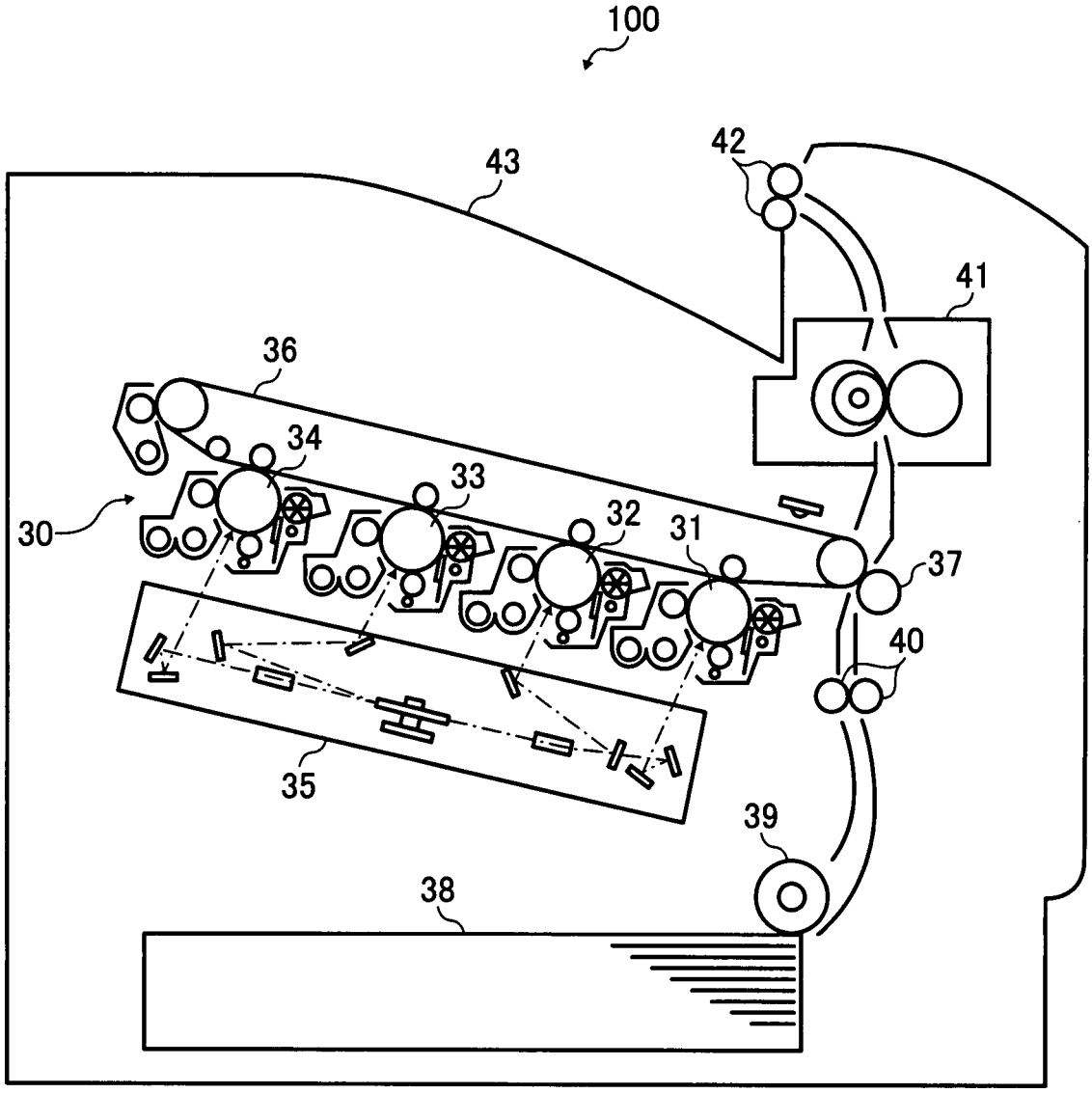
FIG. 4 is a schematic view of an image forming apparatus according to an example embodiment.

Referring now to the drawings, wherein like reference numerals designate identical or corresponding parts throughout the several views, particularly to FIG. 4, an image forming apparatus 100 according to an example embodiment is explained.

As illustrated in FIG. 4, the image forming apparatus 100 includes an optical unit 35, an image forming device 30, an intermediate transfer belt 36, a paper tray 38, a feeding roller 39, a registration roller pair 40, a transferor 37, a fixing device 41, an output roller pair 42, and/or an output tray 43. The image forming device 30 includes photoconductors 31, 32, 33, and/or 34.

The image forming apparatus 100 may be a copying machine, a facsimile machine, a printer, a multifunction printer having copying, printing, scanning, and facsimile functions, or the like. According to example embodiments, the image forming apparatus 100 functions as a color printer for forming a color image on a recording medium by an electrophotographic method.

The optical unit 35 emits laser beams corresponding to yellow, cyan, magenta, and black image data sent from an external device (e.g., a personal computer) toward the image forming device 30. In the image forming device 30, the photoconductors 34, 33, 32, and 31 receive the laser beams to form electrostatic latent images corresponding to the yellow, cyan, magenta, and black image data, respectively. Developing devices (not shown) visualize the electrostatic latent images with yellow, cyan, magenta, and black toners to form yellow, cyan, magenta, and black toner images, respectively. Transferors (not shown) transfer the yellow, cyan, magenta, and black toner images formed on the photoconductors 34, 33, 32, and 31 respectively onto the intermediate transfer belt 36, so that the yellow, cyan, magenta, and black toner images are superimposed on the intermediate transfer belt 36 to form a color toner image.

The paper tray 38 loads a recording medium (e.g., sheets). The feeding roller 39 feeds the sheets one by one toward the registration roller pair 40. The registration roller pair 40 feeds the sheet at a proper time to a transfer nip formed between the intermediate transfer belt 36 and the transferor 37 opposing each other. At the transfer nip, the transferor 37 transfers the color toner image formed on the intermediate transfer belt 36 onto the sheet fed by the registration roller pair 40. The intermediate transfer belt 36 and the transferor 37 feed the sheet bearing the color toner image toward the fixing device 41. In the fixing device 41, heat and pressure is applied to the sheet bearing the color toner image to fix the color toner image on the sheet. The fixing device 41 feeds the sheet bearing the fixed color toner image toward the output roller pair 42. The output roller pair 42 feeds the sheet bearing the fixed color toner image onto the output tray 43.

Figure 5:
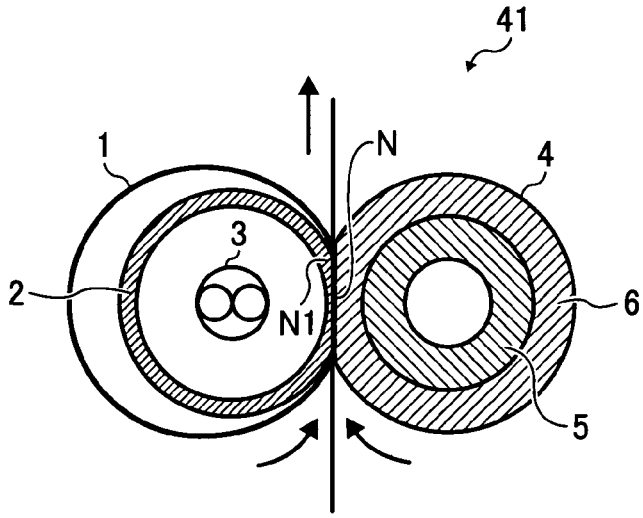
FIG. 5 is a sectional view (according to an example embodiment) of a fixing device of the image forming apparatus shown in FIG. 4.
Figure 6:
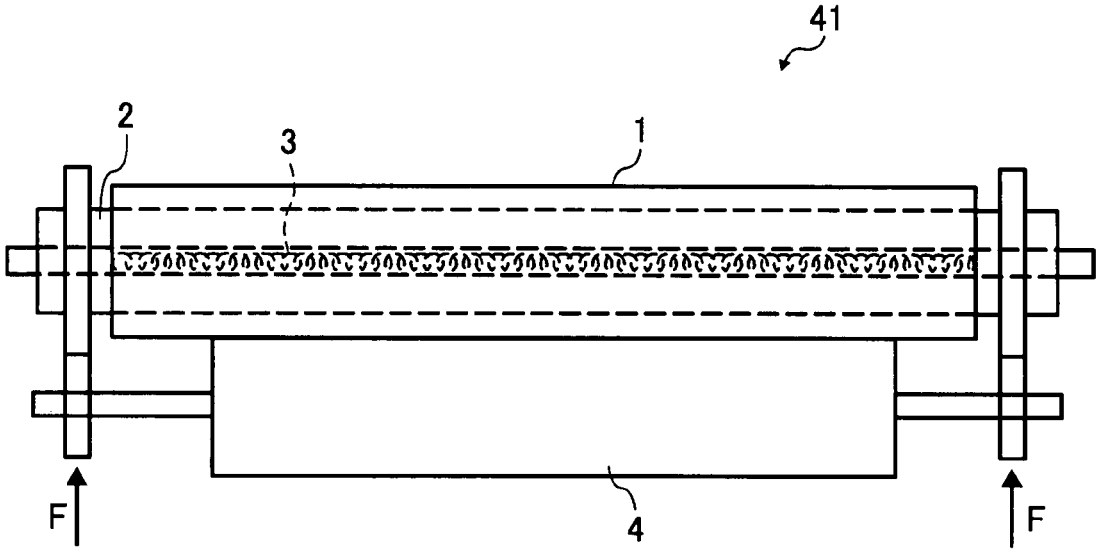
FIG. 6 is a side view (according to an example embodiment) of the fixing device shown in FIG. 5.

Referring to FIGS. 5 and 6, the following describes the fixing device 41. FIG. 5 is a sectional front view of the fixing device 41. FIG. 6 is a sectional side view of the fixing device 41. As illustrated in FIG. 5, the fixing device 41 includes an endless belt 1, a metal thermal conductor 2, a heat source 3, and/or a pressing roller 4. The pressing roller 4 includes a metal roller 5 and/or an elastic layer 6.

The endless belt 1 has flexibility. The metal thermal conductor 2 has a hollow pipe shape and is provided inside a loop formed by the endless belt 1. The heat source 3 includes a heater disposed in the hollow of the metal thermal conductor 2. The pressing roller 4 serves as a pressing member. In the pressing roller 4, the elastic layer 6 is formed on an outer circumferential surface of the metal roller 5 having a hollow shape. As illustrated in FIG. 6, a length of the pressing roller 4 in a longitudinal direction of the pressing roller 4 is shorter than a length of the endless belt 1 in a longitudinal direction of the endless belt 1. The elastic layer 6 (depicted in FIG. 5) of the pressing roller 4 pressingly contacts the endless belt 1.

Figure 7:
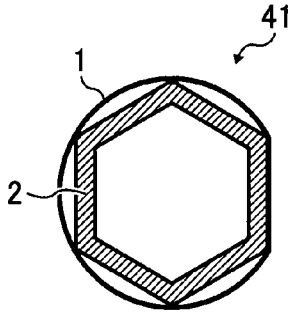
FIG. 7 is a sectional view (according to an example embodiment) of an example metal thermal conductor of the fixing device shown in FIG. 5.

As illustrated in FIG. 5, the metal thermal conductor 2 presses the pressing roller 4 via the endless belt 1 to form a nip N between the endless belt 1 and the pressing roller 4 contacting each other. A portion in which the endless belt 1 contacts the pressing roller 4 (e.g., the nip N) has a flat shape. The hollow pipe shape of the metal thermal conductor 2 includes a cylindrical shape as illustrated in FIG. 5. However, the metal thermal conductor 2 may have a hollow polygonal shape as illustrated in FIG. 7. Alternatively, the metal thermal conductor 2 may have a shape formed by rolling a metal plate. For example, the metal thermal conductor 2 may be a cylinder having a slit in a longitudinal direction of the cylinder.

As illustrated in FIG. 5, in the pressing roller 4, the elastic layer 6 (e.g., a silicon rubber layer) is formed on the outer circumferential surface of the metal roller 5. A surface layer (not shown) for providing a releasing property is formed on the elastic layer 6. The surface layer includes a fluoroplastic resin such as a PFA (perfluoroalkoxy) resin and/or a PTFE (polytetrafluoroethylene) resin. A driving source (e.g., a motor) provided in the image forming apparatus 100 (depicted in FIG. 4), in which the fixing device 41 is provided, generates a driving force. The driving force is transmitted via a gear, for example, to the pressing roller 4 to rotate the pressing roller 4.

As illustrated in FIG. 6, a pressing member (e.g., a spring) applies a pressing force to the pressing roller 4 in a direction F, so that the pressing roller 4 pressingly contacts the endless belt 1. As illustrated in FIG. 5, the pressing force deforms the elastic layer 6 to cause the nip N to have a reference length in a sheet conveyance direction.

The pressing roller 4 may be a solid roller. However, the pressing roller 4 may be a hollow roller because the hollow roller has a small heat capacity. The pressing roller 4 may include a heat source (not shown) such as a halogen heater.

The endless belt 1 includes a metal belt including nickel and/or stainless steel (SUS) and/or an endless loop belt including a resin (e.g., a polyimide and/or the like). The endless belt 1 includes a releasing layer (not shown) serving as a surface layer for providing a releasing property to prevent a toner particle forming a toner image on a sheet from adhering to the endless belt 1. The releasing layer includes a PFA resin and/or a PTFE resin.

The endless belt 1 may further include an elastic layer (not shown) formed between a base (not shown) and the releasing layer and including a silicon rubber. When the elastic layer is not provided, the endless belt 1 has a small heat capacity and thereby provides an increased fixing property. However, when the pressing roller 4 presses a sheet bearing a toner image toward the endless belt 1, surface asperities of the endless belt 1 are transferred onto the toner image and appear on the toner image as orange peel. To prevent this, the elastic layer needs to have a layer thickness not smaller than about 100 μm. When the elastic layer is deformed, the elastic layer absorbs the surface asperities of the endless belt 1 and thereby the orange peel does not appear on the toner image on the sheet. However, the nip N has a decreased thermal conductivity and the endless belt 1 provides a decreased fixing property.

The metal thermal conductor 2 having a hollow pipe shape includes a metal (e.g., aluminum, iron, stainless steel, and/or the like). The cross section of the metal thermal conductor 2 illustrated in FIG. 5 has a circular shape. However, the cross section of the metal thermal conductor 2 may have a rectangular shape, a square shape, or other shape. A nip portion N1 of the metal thermal conductor 2, which contacts an inner circumferential surface of the endless belt 1 to form the nip N between an outer circumferential surface of the endless belt 1 and the pressing roller 4, has a flat or concave shape to improve a releasing property for releasing a sheet from the endless belt 1. The nip portion N1 may be shaped by a cutting or press work or by extruding a metal material to have a reference cross section.

The heat source 3 heats the metal thermal conductor 2 and the endless belt 1 to increase the temperature of the metal thermal conductor 2 and the endless belt 1. The heat source 3 includes a halogen heater as illustrated in FIGS. 5 and 6.

Figure 8:
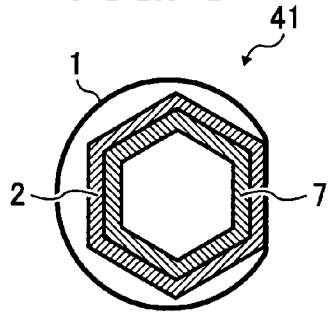
FIG. 8 is a sectional view (according to an example embodiment) of an example heat source of the fixing device shown in FIG. 5.

As illustrated in FIG. 8, the fixing device 41 further includes a resistant heat generator 7. The resistant heat generator 7 is disposed on an inner circumferential surface of the metal thermal conductor 2 and may serve as a heat source instead of the halogen heater serving as the heat source 3 illustrated in FIGS. 5 and 6.

Figure 9:
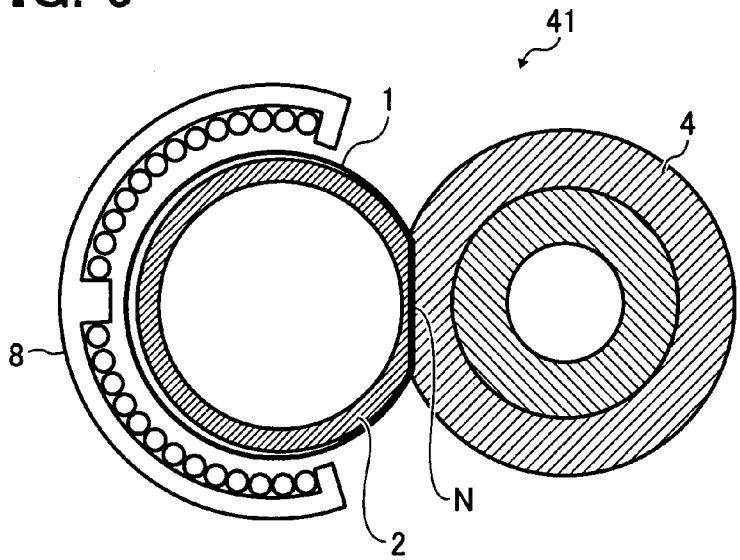
FIG. 9 is a sectional view (according to an example embodiment) of another example heat source of the fixing device shown in FIG. 5.

As illustrated in FIG. 9, the fixing device 41 may further include an induction heater 8. The induction heater 8 faces the outer circumferential surface of the endless belt 1 and may serve as a heat source instead of the halogen heater serving as the heat source 3 illustrated in FIGS. 5 and 6. The induction heater 8 heats the metal thermal conductor 2 via the endless belt 1 to increase the temperature of the metal thermal conductor 2.

An external roller drives the endless belt 1 to move around its circumferential direction. For example, as illustrated in FIG. 5, a driver (not shown) generates a driving force to rotate the pressing roller 4. The driving force is transmitted from the pressing roller 4 to the endless belt 1 at the nip N to rotate the endless belt 1. At the nip N, the endless belt 1 moves in a state that the endless belt 1 is sandwiched between the pressing roller 4 and the metal thermal conductor 2. At a position other than the nip N, the metal thermal conductor 2 guides the endless belt 1 so that the endless belt 1 separates from the metal thermal conductor 2 with a reference distance or smaller provided between the endless belt 1 and the metal thermal conductor 2.

The metal thermal conductor 2 having a polygonal pipe shape may be provided inside the loop formed by the endless belt 1, for example. However, the metal thermal conductor 2 having a cylindrical shape similar to the endless belt 1 may be disposed inside the loop formed by the endless belt 1 with a clearance of from about 0 mm to about 2 mm provided between the endless belt 1 and the metal thermal conductor 2, so as to reduce variation of the temperature of the endless belt 1

Figure 10:
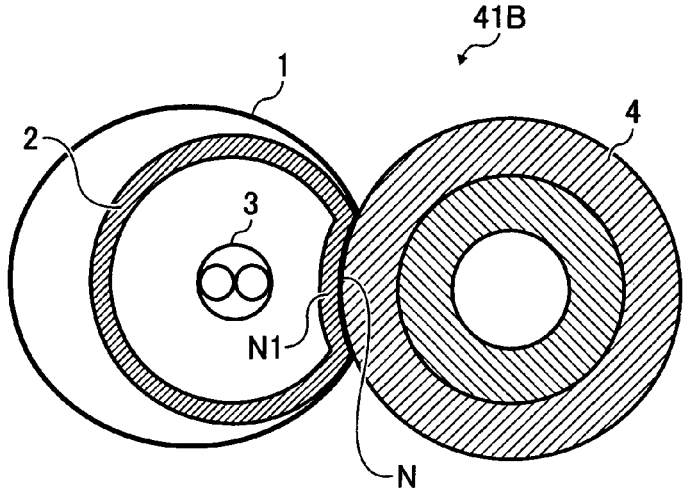
FIG. 10 is a sectional view of a fixing device according to another example embodiment.

FIG. 10 illustrates a fixing device 41B according to another example embodiment. The fixing device 41B includes elements common to the fixing device 41 depicted in FIG. 5. However, the nip portion N1 of the metal thermal conductor 2 does not have a flat shape (depicted in FIG. 5) but has a concave shape. Namely, the nip portion N1 of the metal thermal conductor 2 has the concave shape to cause the nip N formed between the endless belt 1 and the pressing roller 4 to have concave shape.

Figure 11:
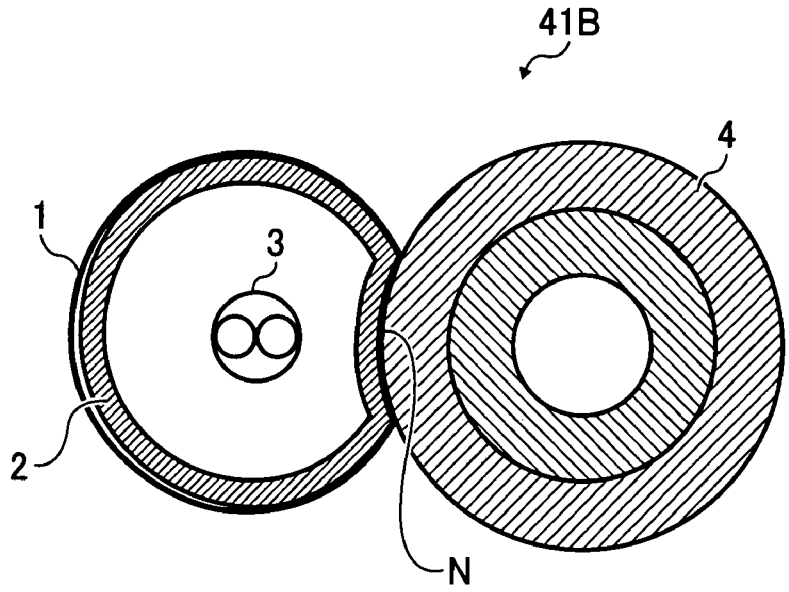
FIG. 11 is a sectional view (according to an example embodiment) of an example metal thermal conductor of the fixing device shown in FIG. 10.

The metal thermal conductor 2 and the endless belt 1 have a similar cylindrical shape in cross section taken on line perpendicular to an axial direction of the metal thermal conductor 2 and the endless belt 1. The metal thermal conductor 2 and the endless belt 1 are disposed close to each other. Alternatively, as illustrated in FIG. 11, the metal thermal conductor 2 may contact an entire inner circumferential surface of the endless belt 1 with a clearance of about 0 mm provided between the endless belt 1 and the metal thermal conductor 2. Actually, a looseness allowing the endless belt 1 to rotate or a looseness allowing the heated metal thermal conductor 2 to thermally expand is provided between the endless belt 1 and the metal thermal conductor 2.

Only the metal thermal conductor 2 and the heat source 3 are provided inside a loop formed by the endless belt 1. Namely, a guide including a resin and an elastic member including a rubber are not provided. Thus, the fixing device 41 (depicted in FIG. 5) or 41B may have a small heat capacity. However, when a thermistor, a thermostat, and/or grease having a small heat capacity and a heat resistance is provided inside the loop formed by the endless belt 1, the fixing device 41 or 41B may have a small heat capacity.

In the fixing device 41 or 41B, the endless belt 1 and the metal thermal conductor 2 are heated. Namely, the fixing device 41 or 41B includes a decreased number of elements and does not include a plurality of rollers provided inside the loop formed by the endless belt 1, a tension roller contacting the endless belt 1, and a resin guide and a metal support stay provided inside the loop formed by the endless belt 1. Thus, the fixing device 41 or 41B has a small heat capacity and a compact size. The fixing device 41 or 41B may be quickly heated, resulting in a shortened warm-up time period. When the image forming apparatus 100 (depicted in FIG. 4) is in a standby mode (e.g., when the image forming apparatus 100 is pre-heated), the entire endless belt 1 is heated. When a fixing operation is requested, the entire endless belt 1 is almost uniformly heated. Thus, the fixing operation may quickly start, resulting in a shortened first print time period (e.g., a time period needed until the image forming apparatus 100 outputs a sheet bearing a fixed toner image after the image forming apparatus 100 receives a print request).

In the fixing device 41 or 41B, the metal thermal conductor 2 having an increased thermal conductivity forms the nip N. Even when the heat source 3 supplies a decreased amount of heat for a fixing operation, heat stored in the metal thermal conductor 2 is transmitted to the endless belt 1 to compensate for the shortage of heat, preventing a decreased fixing temperature. The metal thermal conductor 2 for supplying heat to the nip N has a pipe shape and includes the nip portion N1 forming the nip N and another portion not forming the nip N. When the metal thermal conductor 2 supplies heat to the endless belt 1 at the nip N, heat stored in the portion not forming the nip N flows to the nip portion N1 forming the nip N, because the entire metal thermal conductor 2 has an increased thermal conductivity.

The metal thermal conductor 2 is provided inside the loop formed by the endless belt 1. Therefore, airflow may not cool the metal thermal conductor 2, unlike a rotating heating roller. Thus, the metal thermal conductor 2 may effectively keep heat without a temperature detector such as a thermistor, preventing a decreased temperature of the endless belt 1 caused by time lag in temperature detection and delay in control.

The heat source 3 directly or indirectly heats the metal thermal conductor 2. Convection in an air layer formed between the endless belt 1 and the metal thermal conductor 2, radiant heat generated by the metal thermal conductor 2, or heat conduction from the metal thermal conductor 2 to the endless belt 1 heats the entire endless belt 1. Thus, the fixing device 41 or 41B provides a smaller temperature variation in a circumferential direction of the endless belt 1 than a fixing device using a SURF method or a belt method. As a result, the nip N may provide a decreased temperature variation (e.g., a decreased temperature ripple) and thereby may provide a stable fixing property.

When the fixing device 41 or 41B is provided in a high-speed image forming apparatus, a sheet is conveyed at an increased speed and thereby the endless belt 1 moves at an increased speed. In a fixing device using the SURF method, an endless belt is heated mainly at a nip formed between the endless belt and a pressing roller. After a heated portion on the endless belt moves out of the nip, the heated portion on the endless belt is not heated until the heated portion reaches the nip again. Therefore, the heated portion has a decreased temperature when the heated portion enters the nip. When the endless belt moves at an increased speed, the endless belt has a decreased temperature at an entrance to the nip, resulting in faulty fixing. However, in the fixing device 41 or 41B, the entire endless belt 1 is heated simultaneously. Namely, the endless belt 1 is properly heated while the endless belt 1 moves, reducing faulty fixing.

The fixing device using the SURF method may include a guide for guiding the endless belt so that the endless belt properly moves. When an increased friction generates between the guide and the endless belt contacting each other, the friction may apply an increased load to the endless belt, preventing proper moving of the endless belt.

Figure 12:
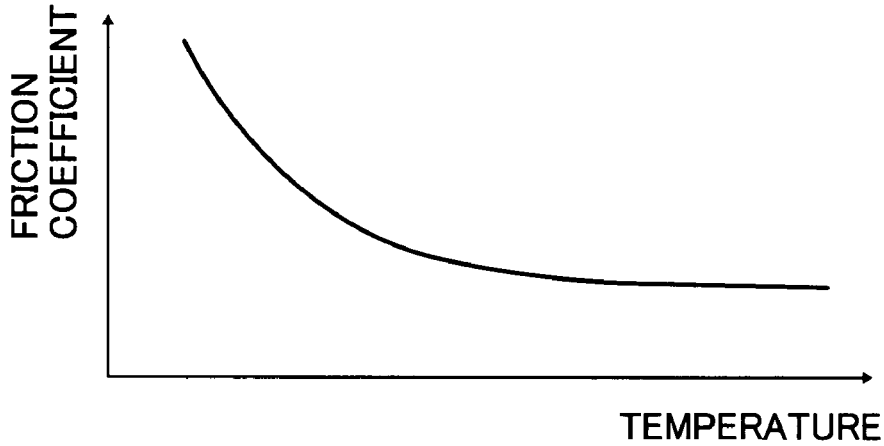
FIG. 12 is a graph (according to an example embodiment) showing a relationship between a temperature of a metal thermal conductor and an endless belt of the fixing device shown in FIG. 10 and a friction coefficient caused between the metal thermal conductor and the endless belt.

In the fixing device 41 or 41B, the metal thermal conductor 2 serves as a guide for guiding the endless belt 1. Namely, the guide has an increased temperature. FIG. 12 is a graph showing a relationship between a temperature of the metal thermal conductor 2 and the endless belt 1 and a friction coefficient caused between the metal thermal conductor 2 including a metal (e.g., aluminum) and the endless belt 1 including a resin. As illustrated in FIG. 12, the friction coefficient decreases as the temperature increases. In the fixing device 41 or 41B, an action for decreasing a friction resistance works between the metal thermal conductor 2 and a resin member forming a surface layer of the endless belt 1. Thus, a proper slipping property may be provided between the endless belt 1 and the metal thermal conductor 2 contacting each other, resulting in proper movement of the endless belt 1.

In the fixing device 41 or 41B, the metal thermal conductor 2 contacts or is disposed close to the endless belt 1, reducing temperature variation in the circumferential direction of the endless belt 1 and maintaining a constant temperature of the endless belt 1. Further, the metal thermal conductor 2 and the endless belt 1 have a similar shape, providing a substantially constant clearance between the metal thermal conductor 2 and the endless belt 1. Thus, an amount of heat conducted to the endless belt 1 may be uniform in the circumferential direction of the endless belt 1. As a result, a uniform surface temperature of the endless belt 1 may prevent temperature variation of the endless belt 1.

The metal thermal conductor 2 contacts the endless belt 1 to conduct heat from the metal thermal conductor 2 to the endless belt 1 so as to increase the temperature of the endless belt 1. The entire endless belt 1 has a uniform temperature. Namely, the temperature of the endless belt 1 does not fluctuate at the nip N, reducing a temperature ripple of the endless belt 1. Even in a standby mode when the endless belt 1 does not move, the entire endless belt 1 is already heated. Thus, a fixing operation may quickly start upon a fixing request.

When the metal thermal conductor 2 is not disposed close to the endless belt 1 but contacts the entire inner circumferential surface of the endless belt 1 as illustrated in FIG. 7, a looseness is not provided between the metal thermal conductor 2 and the endless belt 1. The endless belt 1 is disposed parallel to the nip N and does not have a serpentine shape. Even when an external force is applied to the endless belt 1, the endless belt 1 may not bend or break because the metal thermal conductor 2 contacts and supports the inner circumferential surface of the endless belt 1. In a fixing device using the SURF method or the belt method, a part of an inner circumferential surface of an endless belt is not supported. When the endless belt moves, the inner and outer circumferential surfaces of the part of the endless belt not supported are cooled down, providing a decreased thermal conversion efficiency. In the fixing device 41 or 41B, at least inner circumferential surface of the endless belt 1 contacts the metal thermal conductor 2. Airflow may not cool the endless belt 1, resulting in an increased thermal conversion efficiency.

When the metal thermal conductor 2 is disposed close to the endless belt 1 with a clearance provided between the metal thermal conductor 2 and the endless belt 1, a decreased torque may be needed to move the endless belt 1, resulting in smooth movement of the endless belt 1.

The fixing device 41 or 41B may have a decreased heat capacity inside the loop formed by the endless belt 1 compared to a fixing device using the SURF method or the belt method, because the fixing device 41 or 41B includes no elements to be heated inside the loop formed by the endless belt 1. Thus, the fixing device 41 or 41B provides an increased thermal conversion efficiency. The fixing device 41 or 41B includes only the heat source 3 having a heat resistant property and the metal thermal conductor 2 having a high melting point inside the loop formed by the endless belt 1. For example, the fixing device 41 or 41B does not include a resin member which is included in a fixing device using the SURF method and a silicon rubber which is included in a fixing device using the belt method. Namely, the fixing device 41 or 41B does not include the resin member and the silicon rubber which may be deformed and damaged respectively, when the heat source 3 is accidentally out of control and continuously performs heating.

Figure 13A:
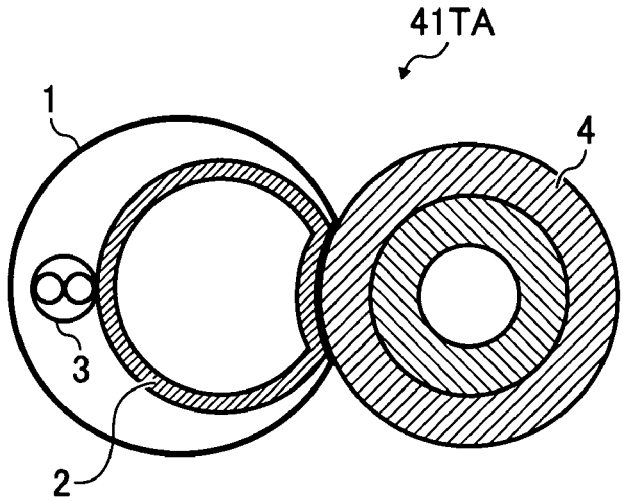
FIG. 13A is an illustration showing a reference arrangement of a heat source of a fixing device.

FIG. 13A illustrates a tester fixing device 41TA in which the heat source 3 is provided between the metal thermal conductor 2 and the endless belt 1. In the tester fixing device 41TA, when the endless belt 1 moves closer to the heat source 3, the endless belt 1 may be excessively heated. Even when the endless belt 1 is stably positioned with respect to the heat source 3, the endless belt 1 may have various temperatures because the endless belt 1 having a small heat capacity is quickly heated.

Figure 13B:
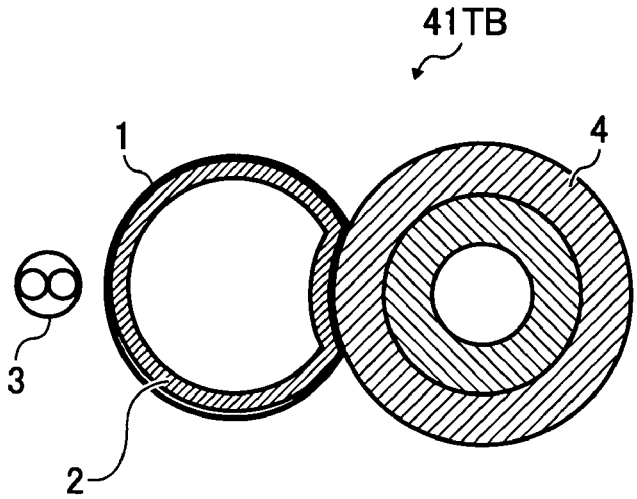
FIG. 13B is an illustration showing another reference arrangement of a heat source of a fixing device.

FIG. 13B illustrates a tester fixing device 41TB in which the heat source 3 is provided outside a loop formed by the endless belt 1. In the tester fixing device 41TB, the heat source 3 radiates heat in a direction in which the endless belt 1 is not disposed as well as in a direction in which the endless belt 1 is disposed, providing a decreased thermal conversion efficiency. Therefore, the heat source 3 may be disposed inside a hollow formed by the metal thermal conductor 2.

Figure 14:
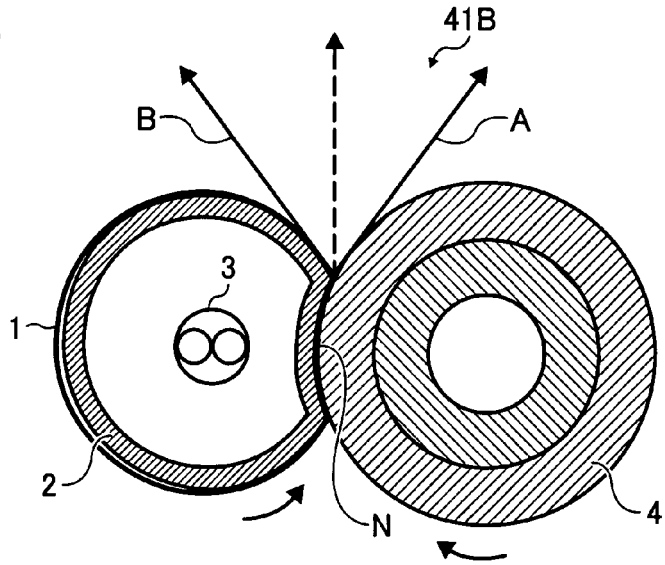
FIG. 14 is an illustration (according to an example embodiment) showing a moving direction and a sheet conveyance direction of an endless belt of the fixing device shown in FIG. 11.

In the fixing device 41 or 41B (depicted in FIG. 5 or 10 respectively), the metal thermal conductor 2 is provided inside the loop formed by the endless belt 1. The nip N has a flat or concave shape. As illustrated in FIG. 14, when a sheet bearing a toner image contacts the endless belt 1 via the toner image having a viscosity, a conveyance direction A of the sheet separates from a moving direction B of the endless belt 1 at an exit of the nip N (e.g., a downstream portion of the nip N in a sheet conveyance direction). The metal thermal conductor 2 guiding the endless belt 1 regulates the moving direction B of the endless belt 1 toward an outer circumferential direction of the endless belt 1. A separating force generates in the conveyance direction A equivalent to a direction tangent to a curve of the nip N at the exit of the nip N. The separating force separates the sheet bearing the toner image from the endless belt 1 against the viscosity of the toner image.

The fixing device 41 or 41B (depicted in FIG. 5 or FIG. 10 respectively) includes a halogen heater serving as the heat source 3 and disposed at a substantially center of the hollow formed by the metal thermal conductor 2. The entire inner circumferential surface of the metal thermal conductor 2 is coated in black to form a blackbody surface. Thus, the entire metal thermal conductor 2 is heated. At the nip N at which the endless belt 1 opposes the heat source 3 via the metal thermal conductor 2, heat is conducted from the metal thermal conductor 2 to the endless belt 1. A portion of the endless belt 1 which does not form the nip N is heated by radiant heat generated by the metal thermal conductor 2 and heat transmitted via the air layer formed between the endless belt 1 and the metal thermal conductor 2. The above-described configuration may provide a proper fixing property. However, the endless belt 1 may be locally heated at the nip N to provide an increased fixing property.

When the endless belt 1 is locally heated at the nip N, an increased amount of heat is supplied to the endless belt 1 to compensate for heat drawn to a sheet. Thus, even when the fixing device 41 or 41B performs a fixing operation at a high speed (e.g., even when the image forming apparatus 100 depicted in FIG. 4 performs an image forming operation at a high speed), the fixing device 41 or 41B may provide a proper fixing property. At the entrance to the nip N (e.g., an upstream portion of the nip N in the sheet conveyance direction), a temperature difference between the sheet and the endless belt 1 is substantially large. Therefore, an increased amount of heat needs to be supplied to the entrance to the nip N. For example, the upstream portion of the nip N in the sheet conveyance direction may be locally heated.

The nip portion N1 of the metal thermal conductor 2 forming the nip N as well as the other portion of the metal thermal conductor 2 include a common material. Thus, even when the endless belt 1 is locally heated at the nip N, heat is transmitted to the other portion of the metal thermal conductor 2 to heat the endless belt 1 when heat is excessively supplied to the sheet. The endless belt 1 may have a constant temperature, preventing variation in fixing property and gloss of a fixed toner image.

Figure 15A:
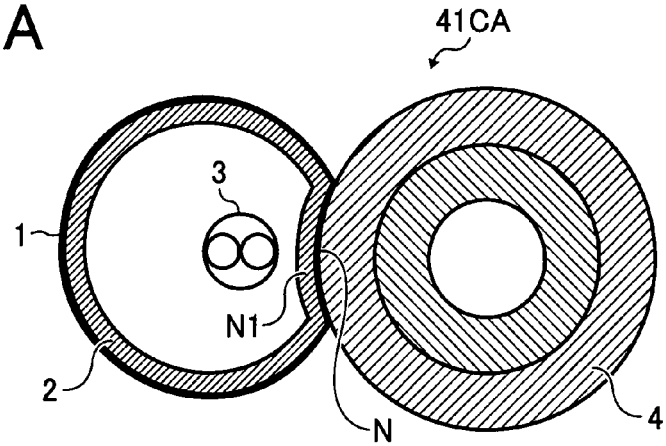
FIG. 15A is an illustration showing an example arrangement of a heat source of a fixing device according to yet another example embodiment.
Figure 15B:
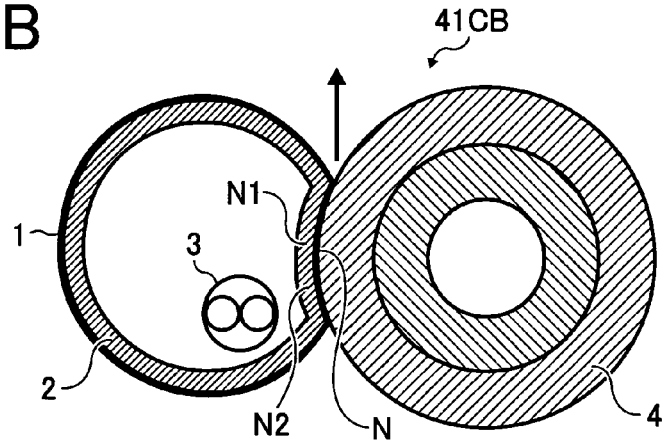
FIG. 15B is an illustration (according to an example embodiment) showing another example arrangement of the heat source shown in FIG. 15A.

FIGS. 15A and 15B illustrate fixing devices 41CA and 41CB, respectively, according to example embodiments. Each of the fixing devices 41CA and 41CB includes elements common to the fixing device 41 (depicted in FIG. 5). Each of the fixing devices 41CA and 41CB includes the heat source 3 (e.g., a halogen heater) located near the nip portion N1 to locally heat the nip portion N1. For example, as illustrated in FIG. 15A, the heat source 3 is disposed near a center of the nip portion N1 in a sheet conveyance direction. As illustrated in FIG. 15B, the heat source 3 is disposed near an upstream portion N2 of the nip portion N1 in a sheet conveyance direction.

Figure 16:
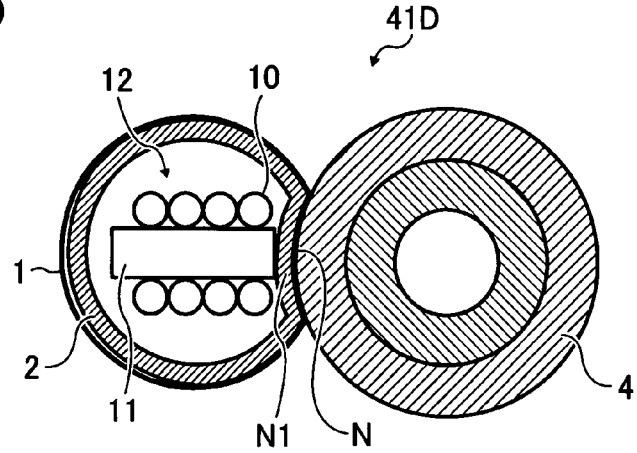
FIG. 16 is a sectional view of a fixing device according to yet another example embodiment.

The heat source 3 may include a halogen heater including a glass tube having a mirror-finished half surface or a ceramic heater disposed close to the nip portion N1. FIG. 16 illustrates a fixing device 41D according to yet another example embodiment. The fixing device 41D includes an induction heater 12 instead of the heat source 3 (depicted in FIG. 5). The induction heater 12 includes a coil 10 and/or a core 11. The coil 10 is coiled around the core 11. The induction heater 12 locally heats the nip N. The other elements of the fixing device 41D are common to the fixing device 41 (depicted in FIG. 5).

In the fixing device 41 or 41B (depicted in FIG. 5 or 10 respectively), the entire endless belt 1 is simultaneously heated. For example, a portion of the endless belt 1 forming the nip N and the other portion of the endless belt 1 are heated. Namely, heat may be supplied to the endless belt 1 more stably than in a fixing device using the SURF method. In the fixing device 41CA (depicted in FIG. 15A), 41CB (depicted in FIG. 15B), or 41D (depicted in FIG. 16), the nip N is locally heated. However, after the nip N is heated, heat is transmitted from the nip N to a portion of the endless belt 1 not forming the nip N.

In the fixing device 41CA, 41CB, or 41D, heat is quickly transmitted to the nip N at which heat is quickly drawn to a sheet. Even when heat is excessively generated, the heat is diffused to an entire circumferential surface of the endless belt 1 because a temperature gradient generates between the nip portion N1 of the metal thermal conductor 2 forming the nip N and the other portion of the metal thermal conductor 2 not forming the nip N. Namely, a sheet may not quickly cool the nip N. Even when the nip N is excessively heated, heat is transmitted from a portion of the endless belt 1 forming the nip N to the other portion of the endless belt 1 not forming the nip N, resulting in a constant temperature of the nip N and a stable fixing property.

As illustrated in FIG. 16, in the fixing device 41D, a portion of the induction heater 12 which generates heat may be limited by changing a coiling of the coil 10 so as to locally heat the endless belt 1. When heat is drawn from the endless belt 1 to a sheet at the nip N, the induction heater 12 may quickly supply heat to the endless belt 1, improving a fixing property.

As illustrated in FIGS. 15A and 15B, when a halogen heater is used as the heat source 3, the fixing device 41CA or 41CB includes a decreased number of elements compared to the fixing device 41D including the coil 10 and the core 11 (depicted in FIG. 16). Thus, the heat source 3 may have a decreased heat capacity and may reduce cost. The halogen heater may have a simpler structure for adjusting a temperature of an end portion of the halogen heater compared to the ceramic heater, resulting in decreased manufacturing costs.

The halogen heater (e.g., the heat source 3) or the induction heater 12 may not be disposed near the nip N due to a layout of elements of the fixing device 41CA, 41CB, or 41D. Further, a mirror-finished halogen heater or the induction heater 12 may increase manufacturing costs.

Figure 17:
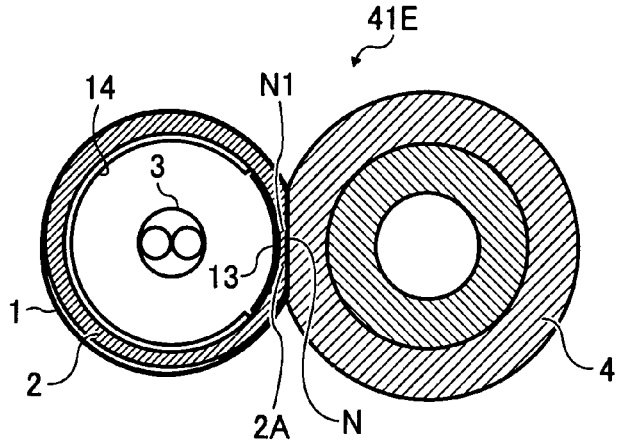
FIG. 17 is a sectional view of a fixing device according to yet another example embodiment.

FIG. 17 illustrates a fixing device 41E according to yet another example embodiment. The fixing device 41E includes a blackbody surface 13, a mirror surface 14, and/or a thin portion 2A. The other elements of the fixing device 41E are common to the fixing device 41 (depicted in FIG. 5). A halogen heater is used as the heat source 3. The blackbody surface 13 is provided on an inner circumferential surface of the nip portion N1 of the metal thermal conductor 2 forming the nip N. Thus, the halogen heater may locally heat the nip N even when the halogen heater is disposed in a center of a loop formed by the endless belt 1. The mirror surface 14 is mirror-finished and is provided on an inner circumferential surface of a portion other than the nip portion N1 of the metal thermal conductor 2, the portion not forming the nip N. The mirror surface 14 reflects light or heat generated by the halogen heater. Thus, the halogen heater may locally heat the blackbody surface 13 provided on the nip portion N1.

The thin portion 2A is provided in the nip portion N1 forming the nip N, and has a thickness smaller than a thickness of a portion of the metal thermal conductor 2 other than the nip portion N1. Thus, the fixing device 41E may provide an increased thermal conductivity to a sheet and may thereby provide a proper fixing property.

When the blackbody surface 13 is provided on the inner circumferential surface of the nip portion N1 of the metal thermal conductor 2, the nip portion N1 absorbs an increased amount of radiant heat generated by the halogen heater. Namely, the halogen heater may locally heat the nip N. When the mirror surface 14 is provided on the inner circumferential surface of the portion other than the nip portion N1 of the metal thermal conductor 2, the mirror surface 14 reflects radiant heat generated by the halogen heater, even when the radiant heat is emitted toward the inner circumferential surface of the portion other than the nip portion N1 of the metal thermal conductor 2. Thus, the halogen heater may locally heat the nip N. The thin portion 2A is provided in the nip portion N1 of the metal thermal conductor 2. Thus, a part of the metal thermal conductor 2 may have a small heat capacity. The thin portion 2A of the metal thermal conductor 2 may be quickly heated and may quickly conduct heat to the endless belt 1. When a sheet draws heat from the endless belt 1 at the nip N, the metal thermal conductor 2 may quickly conduct heat to the endless belt 1 at the nip N, increasing a fixing property.

The endless belt 1 moves on the metal thermal conductor 2 provided inside the loop formed by the endless belt 1. For example, the endless belt 1 slides on the metal thermal conductor 2 at the nip N. When an increased friction generates at an interface between the endless belt 1 and the metal thermal conductor 2, the endless belt 1 may be scraped and damaged by friction.

Figure 18A:
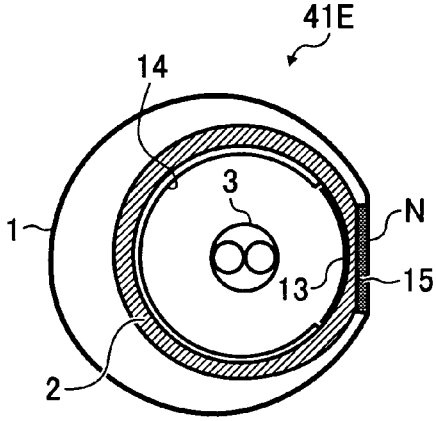
FIG. 18A is a sectional view (according to an example embodiment) of a variation of the fixing device shown in FIG. 17.

As illustrated in FIG. 18A, the fixing device 41E may further include a lubricant 15. The lubricant 15 includes grease and/or oil and is applied to the interface between the endless belt 1 and the metal thermal conductor 2 to reduce friction between the endless belt 1 and the metal thermal conductor 2. Thus, the endless belt 1 may not be scraped and damaged by friction.

Figure 18B:
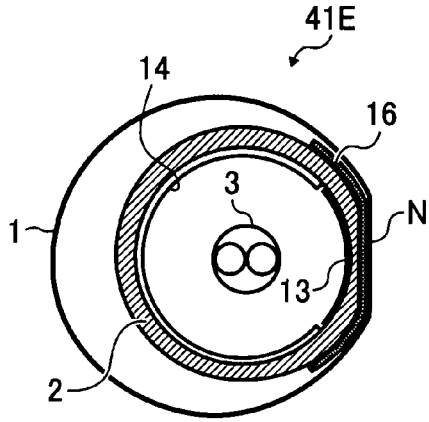
FIG. 18B is a sectional view (according to an example embodiment) of another variation of the fixing device shown in FIG. 17.

The rotating endless belt 1 rotates the lubricant 15. As a result, the lubricant 15 provided at the nip N may be reduced or may become empty. As illustrated in FIG. 18B, the fixing device 41E may include a lubricant sheet 16 instead of the lubricant 15 (depicted in FIG. 18A). The lubricant sheet 16 is impregnated with a lubricant and is provided between the metal thermal conductor 2 and the endless belt 1 to continuously supply the lubricant to the nip N. For example, the lubricant sheet 16 is sandwiched between the metal thermal conductor 2 and the endless belt 1 at the interface between the metal thermal conductor 2 and the endless belt 1. The lubricant sheet 16 is fixed to the metal thermal conductor 2 so that the lubricant sheet 16 is constantly placed at the interface between the metal thermal conductor 2 and the endless belt 1 at the nip N. The lubricant sheet 16 impregnated with a lubricant may maintain its lubricating property.

The lubricant sheet 16 sandwiched between the metal thermal conductor 2 and the endless belt 1 may provide an increased thermal resistance and thereby the fixing device 41E may provide a decreased fixing property.

Figure 19:
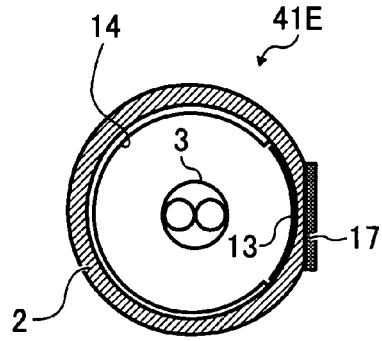
FIG. 19 is a sectional view (according to an example embodiment) of yet another variation of the fixing device shown in FIG. 17.

As illustrated in FIG. 19, the fixing device 41E may include a resin-coated layer 17 instead of the lubricant sheet 16 (depicted in FIG. 18B). The resin-coated layer 17 is formed by coating a portion of the metal thermal conductor 2, which contacts the endless belt 1 (depicted in FIG. 18B), with fluoroplastic (e.g., a PFA resin, a PTFE resin, and/or the like). The resin-coated layer 17 may have a layer thickness of several tens of μm. The resin-coated layer 17 has a small heat resistance and a small surface friction coefficient. Thus, the resin-coated layer 17 may provide a lubricating property for a longer time period than the lubricant sheet 16 while the fixing device 41E provides a proper fixing property.

Figure 20:
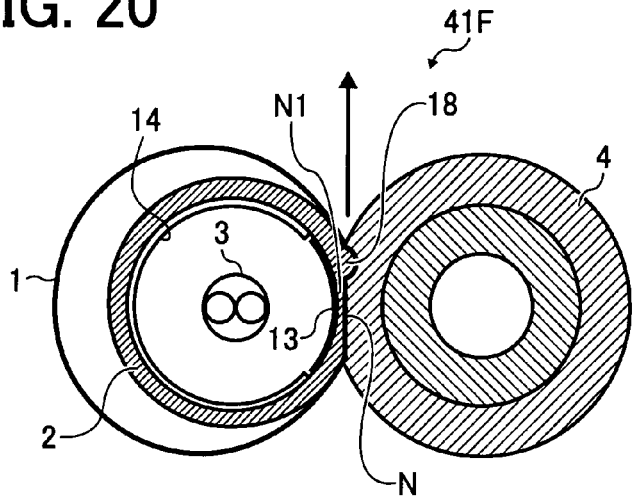
FIG. 20 is a sectional view of a fixing device according to yet another example embodiment.

FIG. 20 illustrates a fixing device 41F according to example embodiments. The metal thermal conductor 2 of the fixing device 41F includes a convex portion 18. The other elements of the fixing device 41F are common to the fixing device 41E (depicted in FIG. 17). A part of the nip portion N1 of the metal thermal conductor 2 protrudes to form the convex portion 18. The convex portion 18 presses a sheet bearing a toner image with an increased pressure. Thus, the fixing device 41F provides an increased fixing property.

When the convex portion 18 is provided at an exit of the nip N (e.g., a downstream portion of the nip portion N1 in a sheet conveyance direction), a curve formed by the metal thermal conductor 2 has a small curvature at the convex portion 18. As a result, a sheet bearing a toner image may easily separate from the endless belt 1, preventing a sheet from being wound around the endless belt 1 and being jammed.

The convex portion 18 causes the endless belt 1 and the pressing roller 4 to pressingly contact each other with an increased pressure. When the pressing roller 4 rotates the endless belt 1, the pressing roller 4 drives the endless belt 1 with an increased friction, preventing the endless belt 1 from slipping on the pressing roller 4.

Generally, a safety device is provided near the heat source 3 to cope with a situation in which temperature control does not properly work. The safety device includes a thermal fuse and/or a thermostat.

According to the above-described example embodiments, the nip N is heated more quickly than any other elements.

When the safety device is provided outside a loop formed by the endless belt 1, the safety device may activate at a delayed time when temperature control does not properly work, because the outside of the loop formed by the endless belt 1 is slowly heated. As a result, the heat source 3 may emit smoke or may catch fire depending on an output of the heat source 3 or a heat capacity of elements forming the heat source 3.

Figure 21:
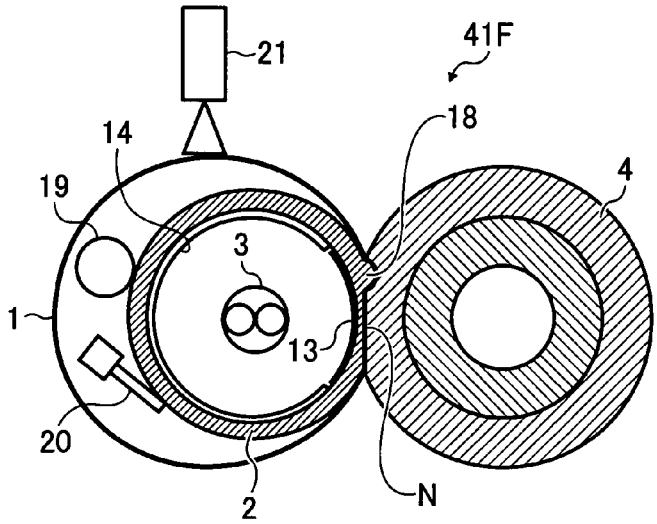
FIG. 21 is a sectional view (according to an example embodiment) of a safety device, a temperature detector, and a non-contact type temperature detector of the fixing device shown in FIG. 20.

As illustrated in FIG. 21, the fixing device 41F may further include a thermal fuse 19, a thermistor 20, and/or a thermopile 21. The thermal fuse 19 serves as a safety device. The thermal fuse 19 is provided between the endless belt 1 and the metal thermal conductor 2 to quickly detect the temperature of the endless belt 1 and/or the metal thermal conductor 2 in a case that temperature control does not properly work. A thermostat instead of the thermal fuse 19 may be used as a safety device.

The thermistor 20 serves as a temperature detector to control the temperature of the nip N. A thermocouple instead of the thermistor 20 may be used as a temperature detector. At a portion other than the nip N, the metal thermal conductor 2 is heated up to a reference temperature more quickly than the endless belt 1. Therefore, the thermistor 20 may directly detect the temperature of the metal thermal conductor 2 instead of the endless belt 1 to detect a response to heat generated by the heat source 3. For example, the thermistor 20 is provided between the endless belt 1 and the metal thermal conductor 2 to detect the temperature of the metal thermal conductor 2. The heat source 3 is controlled based on a detection result so that the heat source 3 heats the metal thermal conductor 2 up to a reference target temperature.

The amount of heat drawn to a sheet bearing a toner image at the nip N varies depending on type and temperature of the sheet. Therefore, the temperature of the endless belt 1 needs to be detected to determine how much the temperature of the endless belt 1 is decreased after the endless belt 1 passes the nip N.

A non-contact type temperature detector may be used to detect the temperature of the endless belt 1. When a contact type temperature detector is used, fine particles (e.g., toner particles) adhered to the endless belt 1 move from the endless belt 1 onto the contact type temperature detector. When the toner particles are accumulated on the contact type temperature detector, the accumulated toner particles may deteriorate detection accuracy or may damage the endless belt 1, forming a faulty line image on a sheet. In the fixing device 41F, the thermopile 21 is used as a non-contact type temperature detector.

In the fixing device 41F including two temperature detectors (e.g., the thermistor 20 and the thermopile 21), a basic temperature control is performed based on a detection result provided by the thermistor 20 to adjust the temperature of the endless belt 1 to a reference target temperature. The thermopile 21 detects a temperature difference caused by type and temperature of a sheet and/or environmental conditions. The thermistor 20 and the thermopile 21 send detection results to a controller (not shown) for controlling the temperature of the endless belt 1.

When the endless belt 1 is disposed close to the metal thermal conductor 2 or contacts the metal thermal conductor 2, heat is quickly transmitted from the metal thermal conductor 2 to the endless belt 1. Therefore, the safety device (e.g., the thermal fuse 19) and the temperature detector (e.g., the thermistor 20 and/or the thermopile 21) may be disposed outside the loop formed by the endless belt 1.

Figure 22:
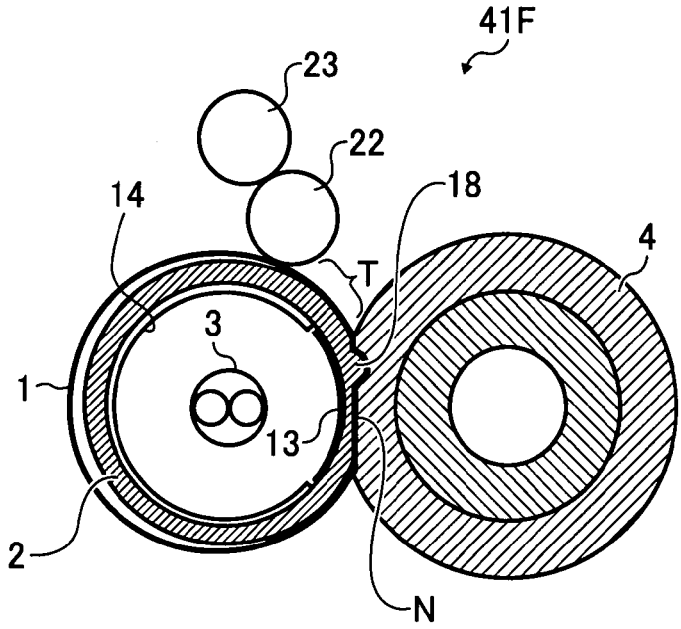
FIG. 22 is a sectional view (according to an example embodiment) of a belt driver of the fixing device shown in FIG. 20.

As illustrated in FIG. 22, the fixing device 41F further includes a driving roller 22 and/or a cleaning roller 23. FIG. 22 illustrates an example structure of a driver for driving the endless belt 1, which may be provided in the fixing device 41, 41B, 41CA, 41CB, 41D, 41E, or 41F depicted in FIG. 5, 10, 15A, 15B, 16, 17, or 20 respectively. The driving roller 22 serves as a belt driver for driving the endless belt 1, and is provided outside the loop formed by the endless belt 1. The driving roller 22 includes a gear (not shown) and/or a silicon rubber layer (not shown). The gear is provided on an end of a shaft of the driving roller 22 and transmits a driving force generated by a driver not shown (e.g., a motor). The silicon rubber layer forms a surface layer contacting the endless belt 1 and having an increased surface friction coefficient. The driving roller 22 transmits a driving force generated by the driver to the endless belt 1 contacting the driving roller 22.

The driving roller 22 may further include a releasing layer (not shown) forming a surface layer of the driving roller 22. The releasing layer includes a PFA resin and/or a PTFE resin. The cleaning roller 23 may contact the surface of the driving roller 22. The cleaning roller 23 includes a surface layer (not shown) including metal, a silicon rubber, and/or felt to collect a substance (e.g., toner particles) adhered to the driving roller 22. When the cleaning roller 23 contacts the driving roller 22, the cleaning roller 23 causes the driving roller 22 to generate a smaller driving force compared to the driving roller 22 including the silicon rubber layer and not being contacted by the cleaning roller 23. However, the cleaning roller 23 may prevent a substance adhered to the driving roller 22 from falling onto the endless belt 1.

A tension T is applied to the endless belt 1 between the exit (e.g., a downstream portion) of the nip N in a sheet conveyance direction and the driving roller 22, so that the rotating endless belt 1 does not slip.

Figure 23:
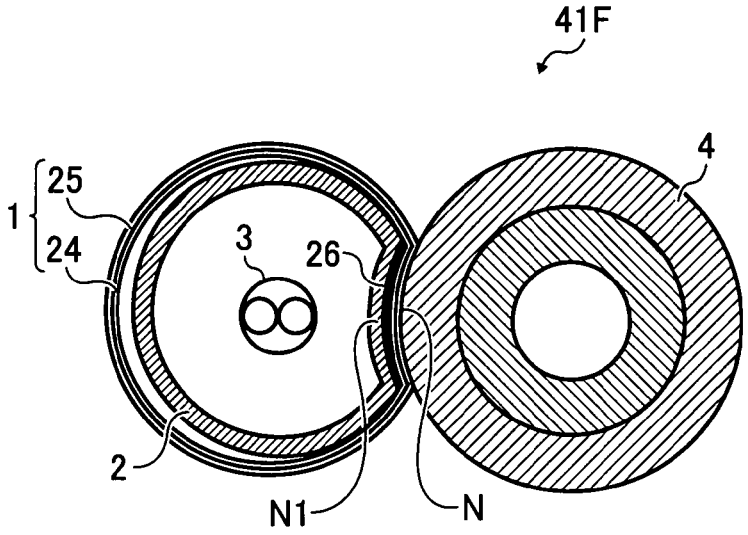
FIG. 23 is a sectional view (according to an example embodiment) of an endless belt of the fixing device shown in FIG. 20.

As illustrated in FIG. 23, the fixing device 41F further includes a heat resistant elastic layer 26. The endless belt 1 includes a base 24 and/or an elastic layer 25.

The endless belt 1 serves as a multilayered belt including the base 24 and the elastic layer 25. The base 24 includes a polyimide resin and/or nickel. The elastic layer 25 includes a silicon rubber.

When the fixing device 41F performs a fixing operation on a sheet bearing a toner image, the elastic layer 25 may include a releasing layer (not shown) which forms a surface layer (e.g., a layer contacting a toner image on a sheet) of the elastic layer 25. The releasing layer includes a PFA resin and/or a PTFE resin. For example, a silicon rubber layer having a layer thickness of from about 100 μm to about 500 μm is formed on the base 24 including a polyimide resin. A releasing layer including a PFA resin and having a layer thickness of from about 10 μm to about 50 μm is formed on the silicon rubber layer.

When the endless belt 1 contacts a sheet bearing a toner image, the elastic layer 25 absorbs asperities of the toner image on the sheet. Thus, the endless belt 1 may uniformly apply heat to the sheet, reducing a faulty toner image appearing as orange peel on the sheet and thereby improving quality of a fixed toner image.

The heat resistant elastic layer 26 is provided between the nip portion N1 of the metal thermal conductor 2 and the endless belt 1. The heat resistant elastic layer 26 includes a silicon rubber and/or a heat resistant felt pad. When the heat resistant elastic layer 26 includes a silicon rubber, the silicon rubber is formed in a sponge shape to provide an increased insulation property. Thus, a decreased amount of heat may be drawn to a sheet at the nip N, preventing faulty fixing.

The silicon rubber or the felt is impregnated with a lubricant (e.g., a silicon oil and/or the like) to provide an improved sliding property of the endless belt 1 at the nip N.

The heat resistant elastic layer 26 absorbs asperities of a toner image on a sheet to cause the sheet to properly contact the endless belt 1, resulting in proper fixing and formation of a high quality image.

The fixing device (e.g., the fixing device 41 depicted in FIG. 5) includes an endless belt (e.g., the endless belt 1 depicted in FIG. 5) having flexibility, a metal thermal conductor (e.g., the metal thermal conductor 2 depicted in FIG. 5) provided inside a loop formed by the endless belt, a heat source (e.g., the heat source 3 depicted in FIG. 5), and/or a pressing member (e.g., the pressing roller 4 depicted in FIG. 5) for pressing the metal thermal conductor via the endless belt to form a nip between the endless belt and the pressing member. The fixing device applies heat and pressure to a recording medium (e.g., a sheet) conveyed through the nip to fix a toner image on a sheet. The metal thermal conductor has a pipe shape and is heated by the heat source. The metal thermal conductor is provided inside the loop formed by the endless belt. The endless belt is movable on the metal thermal conductor. While the metal thermal conductor pressingly opposes the pressing member via the endless belt to form the nip between the pressing member and the endless belt, the metal thermal conductor guides the endless belt moving on the metal thermal conductor. The endless belt and the metal thermal conductor having the pipe shape are heated. Therefore, the endless belt and the metal thermal conductor may be quickly heated, shortening a warm-up time period of the fixing device. The metal thermal conductor having an increased thermal conductivity forms the nip between the pressing member and the endless belt. Thus, even when the heat source supplies a decreased amount of heat to the metal thermal conductor during print operation, heat stored in the metal thermal conductor may be supplied to the endless belt to compensate for the shortage of heat, preventing temperature decrease of the endless belt. The metal thermal conductor for storing heat is provided inside the loop formed by the endless belt. Therefore, the metal thermal conductor may not be easily cooled by airflow, unlike a rotatable metal thermal conductor. Namely, the metal thermal conductor may effectively keep heat and thereby temperature decrease of the metal thermal conductor may be prevented.

The heat source directly or indirectly heats the metal thermal conductor. Convection in an air layer formed between the endless belt and the metal thermal conductor, radiant heat generated by the metal thermal conductor, and/or thermal conduction between the metal thermal conductor and the endless belt heat the entire endless belt. Temperature variation is reduced in the circumferential direction of the endless belt. Namely, the endless belt has a decreased temperature variation (e.g., a decreased temperature ripple) at the nip, providing a stable fixing property. The fixing device may be located in a high-speed image forming apparatus in which a sheet is conveyed at a high speed. The metal thermal conductor having an increased temperature guides the endless belt, reducing a friction resistance. Thus, the endless belt may properly contact and slide on the metal thermal conductor.

In the fixing device, the metal thermal conductor and the endless belt have a similar shape in cross section taken on line perpendicular to an axial direction of the metal thermal conductor and the endless belt. The metal thermal conductor having the pipe shape and the endless belt are disposed close to each other. Temperature variation is reduced in the circumferential direction of the endless belt, improving temperature stability. The metal thermal conductor and the endless belt have a similar shape and are disposed close to each other. Namely, a substantially common clearance is provided between the metal thermal conductor and the endless belt. A uniform amount of heat in the circumferential direction of the endless belt may be conducted to the endless belt. Thus, the endless belt has a uniform surface temperature, preventing temperature variation of the endless belt.

In the fixing device, the metal thermal conductor contacts an entire inner circumferential surface of the endless belt. No looseness is provided between the metal thermal conductor and the endless belt and thereby the endless belt moves in parallel with the nip without serpentining. At least inner circumferential surface of the endless belt contacts the metal thermal conductor and airflow does not cool the endless belt, providing an increased thermal conversion efficiency. Even when a force is applied to the endless belt, the endless belt may not bend or break because the metal thermal conductor supports the inner circumferential surface of the endless belt.

In the fixing device, the metal thermal conductor is provided inside the loop formed by the endless belt. Alternatively, the metal thermal conductor and the heat source are provided inside the loop formed by the endless belt. Thus, a heat capacity inside the loop of the endless belt may be reduced. An increased thermal conversion efficiency may be provided because the heat source needs to heat no extra element other than the metal thermal conductor and the endless belt.

In the fixing device, the heat source is provided in a hollow of the metal thermal conductor, providing an increased thermal conversion efficiency when the heat source heats the metal thermal conductor.

In the fixing device, the metal thermal conductor includes a nip portion (e.g., the nip portion N1 depicted in FIG. 5) to form a nip between the endless belt and the pressing member. The nip portion has a flat shape or a concave shape. Therefore, a sheet bearing a toner image, which is adhered to the endless belt via the toner image having viscosity, may properly separate from the endless belt at an exit of the nip in a sheet conveyance direction and may move in a direction different from a direction in which the endless belt moves.

In the fixing device, the metal thermal conductor includes the nip portion to form the nip between the endless belt and the pressing member and the nip portion includes an upstream portion (e.g., the upstream portion N2 depicted in FIG. 15B) in the sheet conveyance direction. The heat source locally heats the nip portion or the upstream portion, resulting in a stable temperature of the nip and a stable fixing property.

In the fixing device, an induction heater is used as the heat source for locally heating the nip portion or the upstream portion. A portion of the induction heater, which generates heat, may be limited by changing winding of a coil included in the induction heater. Even when heat is drawn from the endless belt to a sheet at the nip, the induction heater may quickly supply heat to the endless belt, providing an increased fixing property.

In the fixing device, a halogen heater is used as the heat source for locally heating the nip portion or the upstream portion. The halogen heater does not include a coil and/or a core included in the induction heater. Namely, a number of elements included in the heat source is decreased, resulting in a decreased heat capacity and a decreased manufacturing cost of the heat source.

In the fixing device, the fixing device further includes a blackbody surface (e.g., the blackbody surface 13 depicted in FIG. 17) for receiving radiant heat generated by the halogen heater, and provided on an inner circumferential surface of the nip portion or the upstream portion of the metal thermal conductor. Thus, radiant heat generated by the halogen heater may be substantially absorbed at the nip portion or the upstream portion. The metal thermal conductor may be locally heated and may quickly supply heat to the endless belt when heat is drawn from the endless belt to a sheet at the nip, providing an increased fixing property.

The fixing device further includes a mirror surface (e.g., the mirror surface 14 depicted in FIG. 17) to receive radiant heat generated by the halogen heater, and provided on an inner circumferential surface of a portion not forming the nip portion or the upstream portion of the metal thermal conductor. The mirror surface (e.g., a portion of the metal thermal conductor other than the nip portion) reflects radiant heat generated by the halogen heater. Namely, the halogen heater may intensively heat the nip portion. Thus, the metal thermal conductor may be locally heated and may quickly supply heat to the endless belt when heat is drawn from the endless belt to a sheet at the nip, providing an increased fixing property.

In the fixing device, the nip portion or the upstream portion of the metal thermal conductor has a thickness smaller than a thickness of a portion of the metal thermal conductor other than the nip portion or the upstream portion. Namely, a part (e.g., the nip portion or the upstream portion) of the metal thermal conductor has a small heat capacity and is easily heated. Thus, heat is quickly transmitted from the metal thermal conductor to the endless belt. The metal thermal conductor may quickly supply heat to the endless belt when heat is drawn from the endless belt to a sheet at the nip, providing an increased fixing property.

The fixing device further includes a lubricant (e.g., the lubricant 15 depicted in FIG. 18A) provided between the endless belt and the metal thermal conductor. Thus, friction between the endless belt and the metal thermal conductor may be reduced, preventing wear of the endless belt.

The fixing device further includes a lubricant sheet (e.g., the lubricant sheet 16 depicted in FIG. 18B) impregnated with a lubricant and provided between the endless belt and the metal thermal conductor. The lubricant is constantly supplied to the inner circumferential surface of the endless belt. Thus, friction between the endless belt and the metal thermal conductor may be reduced for a long time period, preventing wear of the endless belt.

In the fixing device, a PFA resin or a PTFE resin is coated on a portion of the metal thermal conductor, which contacts the endless belt. Friction coefficient between the metal thermal conductor and the endless belt is decreased. Namely, friction between the metal thermal conductor and the endless belt may be reduced for a longer time period compared to a case in which grease is applied on the metal thermal conductor, preventing wear of the endless belt.

The metal thermal conductor further includes a convex portion (e.g., the convex portion 18 depicted in FIG. 20) provided on a part of the nip portion of the metal thermal conductor. The metal thermal conductor presses the pressing member via the endless belt with an increased pressure at the convex portion, providing an increased fixing property. The endless belt and the pressing member pressingly contact each other with an increased pressure. The pressing member may drive the endless belt with an increased friction, preventing the endless belt from slipping on the pressing member.

In the fixing device, the convex portion of the metal thermal conductor is provided on a downstream portion (e.g., an exit) of the nip portion of the metal thermal conductor in the sheet conveyance direction. The endless belt partially has an increased curvature. Thus, a sheet may easily separate from the endless belt, preventing the sheet from winding around the endless belt.

The fixing device further includes a safety device (e.g., the thermal fuse 19 depicted in FIG. 21) for detecting a temperature of the metal thermal conductor and provided between the metal thermal conductor and the endless belt. When the safety device detects an abnormal temperature, power supply to the heat source is stopped. Thus, the fixing device may detect an abnormal temperature more quickly than a fixing device in which a thermal fuse and/or a thermostat is provided outside a loop formed by an endless belt.

The fixing device further includes a temperature detector (e.g., the thermistor 20 depicted in FIG. 21) for detecting a temperature of the metal thermal conductor and provided between the metal thermal conductor and the endless belt. The fixing device may detect increase and decrease of the temperature of the metal thermal conductor caused by the heat source more quickly than a fixing device in which the temperature of a metal thermal conductor is detected via an endless belt. Thus, the fixing device may properly control the temperature of the endless belt and may reduce temperature ripple of the endless belt.

The fixing device further includes a non-contact type temperature detector (e.g., the thermopile 21 depicted in FIG. 21) for detecting the temperature of the endless belt and provided outside the loop formed by the endless belt. The non-contact type temperature detector may detect an amount of heat drawn from the endless belt to a sheet. A detection result is sent to a controller for controlling the temperature of the endless belt. Thus, a fixing temperature may be properly adjusted.

The fixing device further includes a belt driver (e.g., the driving roller 22 depicted in FIG. 22) for driving the endless belt. The belt driver has a roller shape and is provided outside the loop formed by the endless belt. The belt driver applies a tension to the endless belt while the endless belt moves from a downstream portion in the sheet conveyance direction of the nip formed between the endless belt and the metal thermal conductor to the belt driver. The belt driver collects a substance (e.g., toner particles) adhered to the endless belt, preventing the substance from adhering to the endless belt. The belt driver provided outside the loop of the endless belt drives the endless belt and applies a tension to the endless belt, preventing slipping of the endless belt.

In the fixing device, the endless belt has a multilayered structure in which the endless belt includes a base (e.g., the base 24 depicted in FIG. 23) and an elastic layer (e.g., the elastic layer 25 depicted in FIG. 23) formed on an outer circumferential surface of the base and having a layer thickness not smaller than about 100 μm. When the endless belt contacts a sheet bearing a toner image, the elastic layer absorbs asperities of the toner image on the sheet. Thus, the endless belt may uniformly apply heat to the sheet. Asperities may not appear as orange peel on the toner image on the sheet, resulting in proper fixing and formation of a high quality image.

The fixing device further includes a heat resistant elastic layer (e.g., the heat resistant elastic layer 26 depicted in FIG. 23) provided between the endless belt and the nip portion of the metal thermal conductor. The heat resistant elastic layer causes the endless belt to uniformly contact a sheet, resulting in proper fixing and formation of a high quality image.

An image forming apparatus (e.g., the image forming apparatus 100 depicted in FIG. 4) includes an image forming device (e.g., the image forming device 30 depicted in FIG. 4) for forming a toner image on a recording medium (e.g., a sheet) and a fixing device (e.g., the fixing device 41 depicted in FIG. 4) for fixing the toner image formed on the recording medium by applying heat and pressure to the recording medium. The image forming apparatus includes the fixing device according to the above-described example embodiments, providing a stable fixing property and formation of a high quality image.

In the fixing device according to the above-described example embodiments, the heat source heats the metal thermal conductor having a pipe shape and the endless belt. The metal thermal conductor and the endless belt may be quickly heated, shortening a warm-up time period. The metal thermal conductor having an increased thermal conductivity forms a nip between the endless belt and the pressing member. Even when the heat source supplies a decreased amount of heat for a fixing operation, heat stored in the metal thermal conductor is transmitted to the endless belt to compensate for the shortage of heat, preventing a decreased fixing temperature. The metal thermal conductor for storing heat is provided inside a loop formed by the endless belt. The metal thermal conductor may not be easily cooled by airflow, unlike a rotatable metal thermal conductor. Namely, the metal thermal conductor may effectively keep heat and thereby temperature decrease of the metal thermal conductor may be prevented.

The heat source directly or indirectly heats the metal thermal conductor. Convection in an air layer formed between the endless belt and the metal thermal conductor, radiant heat generated by the metal thermal conductor, or heat conduction from the metal thermal conductor to the endless belt heats the entire endless belt. Thus, the fixing device provides a decreased temperature variation in the circumferential direction of the endless belt. As a result, the nip may provide a decreased temperature variation (e.g., a decreased temperature ripple) and thereby may provide a stable fixing property. Therefore, the fixing device may be provided in a high-speed image forming apparatus in which a sheet is conveyed at a high speed. The metal thermal conductor having an increased temperature contacts and guides the endless belt. Therefore, an action for decreasing a friction resistance works between the metal thermal conductor and the endless belt. Thus, a proper slipping property may be provided between the endless belt and the metal thermal conductor contacting each other.

When an image forming apparatus includes the fixing device according to the above-described example embodiments, the image forming apparatus may provide a stable fixing property and formation of a high quality image.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An image forming apparatus, comprising:

an image forming device to form a toner image on a recording medium; and a fixing device to fix the toner image formed on the recording medium by applying heat and pressure to the recording medium, the fixing device including a flexible, movable endless belt to apply heat to the recording medium, a metal thermal conductor having a hollow endless cylindrical shape and inside a loop formed by the endless belt, the metal thermal conductor guiding the moving endless belt that slides over the metal thermal conductor, a heat source to heat the metal thermal conductor, and a pressing member to press the metal thermal conductor via the endless belt to form a nip between the endless belt and the pressing member, the nip at which the endless belt and the pressing member nip the recording medium bearing the toner image to apply heat and pressure to the recording medium.

2. The image forming apparatus according to claim 1, wherein the metal thermal conductor and the endless belt have a similar cross sectional shape along an axis perpendicular to an axial direction of the metal thermal conductor and the endless belt, and wherein the metal thermal conductor and the endless belt are disposed close to each other.

3. The image forming apparatus according to claim 1, wherein the metal thermal conductor contacts an entire inner circumferential surface of the endless belt.

4. The image forming apparatus according to claim 1, wherein the metal thermal conductor and the heat source are inside the loop formed by the endless belt.

5. The image forming apparatus according to claim 1, wherein the heat source is in the hollow endless cylindrical shape of the metal thermal conductor.

6. The image forming apparatus according to claim 1, wherein the metal thermal conductor includes a nip portion to form the nip between the endless belt and the pressing member, and wherein a surface of the nip portion facing the endless belt has one of a flat shape and a concave shape.

7. The image forming apparatus according to claim 1, wherein the metal thermal conductor includes a nip portion to form the nip between the endless belt and the pressing member, and the nip portion includes an upstream portion in a recording medium conveyance direction, and wherein the heat source locally heats one of the nip portion and the upstream portion.

8. The image forming apparatus according to claim 7, wherein the heat source includes one of an induction heater and a halogen heater.

9. The image forming apparatus according to claim 8, wherein the fixing device further includes a blackbody surface to receive radiant heat generated by the halogen heater, and is on an inner circumferential surface of one of the nip portion and the upstream portion of the metal thermal conductor.

10. The image forming apparatus according to claim 8, wherein the fixing device further includes a mirror surface to receive radiant heat generated by the halogen heater, and provided on an inner circumferential surface of a portion not forming one of the nip portion and the upstream portion of the metal thermal conductor.

11. The image forming apparatus according to claim 7, wherein one of the nip portion and the upstream portion has a thickness smaller than a thickness of a portion not forming one of the nip portion and the upstream portion of the metal thermal conductor.

12. The image forming apparatus according to claim 1, wherein the fixing device further includes one of a lubricant and a lubricant sheet between the endless belt and the metal thermal conductor, and wherein the lubricant sheet is impregnated with the lubricant.

13. The image forming apparatus according to claim 1, wherein one of a PFA (perfluoroalkoxy) resin and a PTFE (polytetrafluoroethylene) resin is coated on a portion of the metal thermal conductor, which contacts the endless belt.

14. The image forming apparatus according to claim 1, wherein the metal thermal conductor further includes a convex portion on one of a part of the nip portion of the metal thermal conductor and a downstream portion of the nip portion of the metal thermal conductor in a recording medium conveyance direction.

15. The image forming apparatus according to claim 1, wherein the fixing device further includes a safety device between the metal thermal conductor and the endless belt to detect a temperature of the metal thermal conductor, and wherein the safety device stops power supply to the heat source when the safety device detects an abnormal temperature of the metal thermal conductor.

16. The image forming apparatus according to claim 1, wherein the fixing device further includes a temperature detector between the metal thermal conductor and the endless belt to detect a temperature of the metal thermal conductor.

17. The image forming apparatus according to claim 1, wherein the fixing device further includes a belt driver outside the loop formed by the endless belt to drive the endless belt, the belt driver having a roller shape, and wherein the belt driver applies a tension to the endless belt while the endless belt moves from a downstream portion in a recording medium conveyance direction of the nip formed between the endless belt and the metal thermal conductor to the belt driver.

18. The image forming apparatus according to claim 1, wherein the endless belt has a multilayered structure in which the endless belt includes a base and an elastic layer on an outer circumferential surface of the base and having a layer thickness not smaller than about 100 μm.

19. The image forming apparatus according to claim 1, wherein the fixing device further includes a heat resistant elastic layer between the endless belt and the nip portion of the metal thermal conductor.

20. The image forming apparatus according to claim 1, wherein the metal thermal conductor comprises:

a first arc portion facing the nip formed between the endless belt and the pressing member and provided along an outer circumferential surface of the pressing member; and a second arc portion not facing the nip formed between the endless belt and the pressing member and provided along an inner circumferential surface of the endless belt.

21. A fixing device for fixing a toner image formed on a recording medium by applying heat and pressure to the recording medium, the fixing device comprising:

a flexible, movable endless belt to apply heat to the recording medium;

a metal thermal conductor having a hollow endless cylindrical shape and inside a loop formed by the endless belt, the metal thermal conductor to guide the moving endless belt that slides over the metal thermal conductor;

a heat source to heat the metal thermal conductor; and a pressing member to press the metal thermal conductor via the endless belt to form a nip between the endless belt and the pressing member, the nip at which the endless belt and the pressing member nip the recording medium bearing the toner image to apply heat and pressure to the recording medium.

22. The fixing device according to claim 21, wherein the metal thermal conductor comprises:

a first arc portion facing the nip formed between the endless belt and the pressing member and provided along an outer circumferential surface of the pressing member; and a second arc portion not facing the nip formed between the endless belt and the pressing member and provided along an inner circumferential surface of the endless belt.

23. An image forming apparatus, comprising:

an image forming device to form a toner image on a recording medium; and a fixing device to fix the toner image formed on the recording medium by applying heat and pressure to the recording medium, the fixing device including:

a flexible, movable endless belt, formed into a loop, to apply heat to the recording medium, a pressing roller provided outside the loop formed by the endless belt to contact the endless belt to form a nip portion therebetween, the pressing roller transmits a driving force to the endless belt at the nip portion, a heat source to heat the endless belt, and a belt driver to contact the endless belt to transmit a driving force to the endless belt at a portion except for the nip portion, wherein no roller, which contacts the endless belt, is disposed inside the loop formed by the endless belt.

24. The image forming apparatus according to claim 23, wherein the belt driver includes a driving roller in contact with an outer surface of the endless belt.

25. The image forming apparatus according to claim 24, further comprising a cleaning roller in contact with an outer surface of the driving roller.

26. The image forming apparatus according to claim 23, further comprising a metal thermal conductor provided inside the loop formed by the endless belt.

27. The image forming apparatus according to claim 26, wherein the metal thermal conductor is in contact with at least a portion of an inner surface of the endless belt except for the nip portion.

28. The image forming apparatus according to claim 26, wherein the metal thermal conductor has a hollow endless cylindrical shape.

29. The image forming apparatus according to claim 23, wherein the heat source includes a halogen heater.

30. The image forming apparatus according to claim 23, wherein the heat source includes an induction heater disposed outside the loop formed by the endless belt.

31. The image forming apparatus according to claim 27, further comprising a lubricant applied to the inner surface of the endless belt.

32. The image forming apparatus according to claim 27, further comprising a lubricant sheet provided on the inner surface of the endless belt at the nip portion.

33. The image forming apparatus according to claim 23, wherein the endless belt includes a metal layer, an elastic layer, and a releasing layer.

34. The image forming apparatus according to claim 26, further comprising a thermistor provided inside the loop formed by the endless belt.

35. The image forming apparatus according to claim 34, wherein the thermistor detects a temperature of the endless belt.

36. The image forming apparatus according to claim 35, wherein the heat source is controlled by a detection result of the thermistor.

37. The image forming apparatus according to claim 34, wherein the thermistor detects a temperature of the metal thermal conductor.

38. The image forming apparatus according to claim 26, further comprising a thermopile provided outside the loop formed by the endless belt, the thermopile being in non-contact with the endless belt.

39. The image forming apparatus according to claim 26, further comprising a thermostat provided inside the loop formed by the endless belt, the thermostat detecting a temperature of the endless belt.

40. The image forming apparatus according to claim 23, wherein the belt driver transmits the driving force to the endless belt while the pressing roller contacts the endless belt to form the nip portion therebetween.

* * * * *